United States Patent [19]

Boller et al.

[11] 4,290,219

[45] * Sep. 22, 1981

[54] TARGET SIGHT RECORDING APPARATUS

[76] Inventors: Hans Boller, Alte Landstrasse 79, Thalwil; Max Oschwald, In der Fadmatt 26, Urdorf, both of Switzerland

[ * ] Notice: The portion of the term of this patent subsequent to Jul. 22, 1996, has been disclaimed.

[21] Appl. No.: 692,452

[22] Filed: Jun. 3, 1976

[30] Foreign Application Priority Data

Jun. 4, 1975 [CH] Switzerland ..... 7170/75

[51] Int. Cl.[3] ..... F41C 27/00

[52] U.S. Cl. ..... 42/1 R; 42/1 ST; 354/76

[58] Field of Search ..... 42/1 R, 1 A, 1 ST; 354/75, 76; 352/95; 346/107 R

[56] References Cited

U.S. PATENT DOCUMENTS

| | | | |
|---|---|---|---|
| 1,955,300 | 4/1934 | Kurnick | 42/1 R |
| 1,960,998 | 5/1934 | Hindley et al. | 42/1 R |
| 2,144,909 | 1/1939 | Atkin et al. | 42/1 R |
| 2,416,769 | 3/1947 | Palmer | 42/1 R |
| 3,545,356 | 12/1970 | Nielsen | 42/1 R |
| 3,785,261 | 1/1974 | Ganteaume | 42/1 A |

*Primary Examiner*—Charles T. Jordan

[57] ABSTRACT

A rifle having a telescopic sight has apparatus for recording the target as seen through the telescopic sight at the instant the trigger is pulled. The apparatus includes a beam splitter for directing to a camera some of the light passing through the telescopic sight. The shutter mechanism of the camera is coupled to the rifle trigger so that the camera will "shoot" the picture of the target when the trigger is pulled. The camera is of the instant-copy type so that pictures of the target can be viewed shortly after "shooting". The apparatus thus enables the ability of a rifleman to be tested without the need for firing live ammunition.

13 Claims, 5 Drawing Figures

TARGET SIGHT RECORDING APPARATUS

RELATED APPLICATIONS

Switzerland filed June 4, 1975.

BACKGROUND OF THE INVENTION

1. Field of the Invention

The present invention relates to target sight recording apparatus, for use in conjunction with telescopically sighted rifles for example.

2. Description of the Prior Art

There are numerous occasions on which it is desirable to conduct a firing practice on moving targets in particular, without at the same time having to fire live rounds. Until now, however, there have been no suitably economic means and methods of checking or determining with adequate precision whether the firearm had been accurately aimed at the target at the instant of actuation of the trigger of the firearm, or of indicating where the projectile would have struck had the weapon been loaded with live ammunition.

An object of the invention, therefore, is to provide a relatively uncomplicated and inexpensive target sighting apparatus for providing a photographic record of the target aimed at via a telescopic sight during actuation of the trigger of the firearm.

SUMMARY OF THE INVENTION

According to the invention there is provided in a firearm having a trigger and a telescopic sight through which light from a target zone can pass along the optical axis of the sight through an eyepiece to reach the eye of an observer, target sight recording apparatus comprising an optical beam splitter element rigid with the telescopic sight for diverting a fraction of the light passing through the telescopic sight along a path extending at an angle to the optical axis, a photographic camera rigid with the telescopic sight and inclined at an angle to receive the deflected light, the camera having an objective lens system, a camera shutter, a cassette for housing photographic exposure material all aligned along the optical axis of the camera and a shutter releasing device coupled to actuate the camera shutter, and means coupling the shutter release device with the trigger of the firearm so that upon operating the trigger the camera shoots the picture which at that instant the observer can view through the telescopic sight.

BRIEF DESCRIPTION OF THE DRAWINGS

Target sighting apparatus embodying the invention will now be described, by way of example, with reference to the accompanying diagrammatic drawings in which.

DESCRIPTION OF THE PREFERRED EMBODIMENTS

Figures 1, 3:
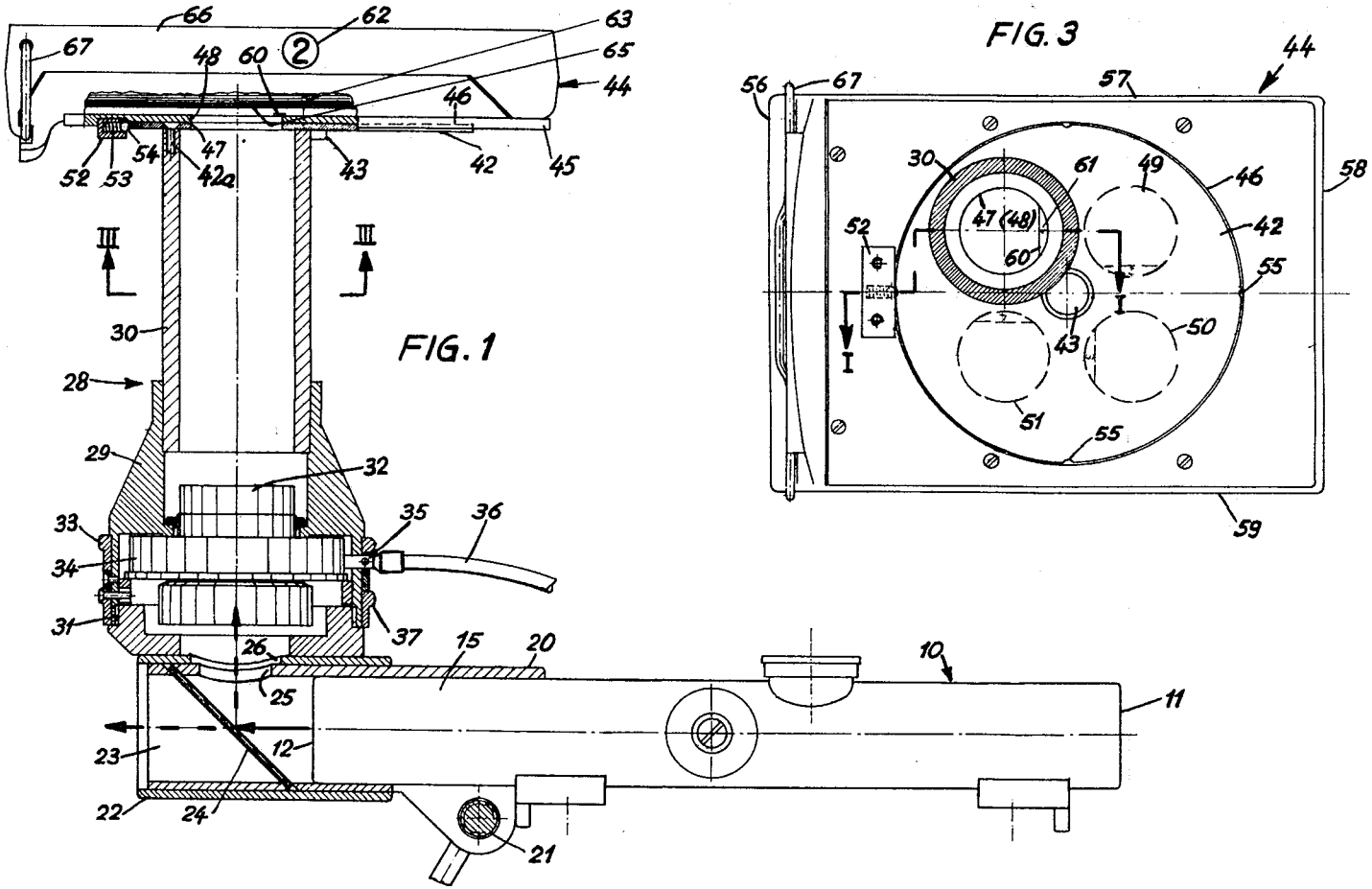
FIG. 1 is a fragmentary section of the target sighting apparatus taken along the line I—I in FIG. 3.
FIG. 3 is a section of the apparatus of FIG. 1 taken along the line III—III.
Figure 2:
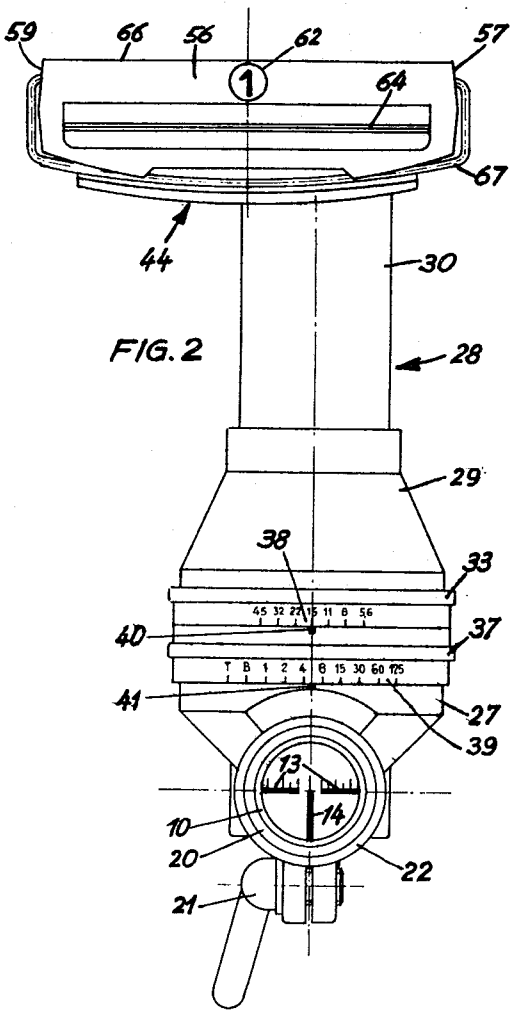
FIG. 2 is a rear elevation of the apparatus of FIG. 1.

The target sighting apparatus shown in FIGS. 1 and 2 includes a telescopic sight 10 of conventional construction and which is to be secured to a rifle. The sight 10 has an output lens 11 at one end arranged to face the target and an eyepiece 12 at the other end. Upon looking through the eyepiece 12 of the telescopic sight 10, a sight graticule 13, 14 (FIG. 2) for marking the theoretical striking point of the bullet in the target plane, is superimposed on the image of the target plane.

The body 15 of the telescopic sight 10 adjacent to the eyepiece 12 carries a removably attached clamping sleeve 20 which can be tightened around the body 15 of the sight 10 by means of a clamping device 21. The clamping sleeve 20 carries a tube 22 which together with the clamping sleeve acts as a tubular rearward extension of the telescopic sight and has an eyepiece aperture 23. An optical beam splitter element in the form of a partially transparent mirror 24 is located within the clamping sleeve 20. The plane of the mirror lies at an angle of 45° with respect to the optical axis of the telescopic sight 10. The clamping sleeve 20 and the tube 22 have respectively aligned apertures 25 and 26 through which light rays deflected by the mirror 24 pass. The aligned apertures 25 and 26 are surrounded by a tubular housing 27 secured to the tube 22 in a lightproof and rigid manner. The tubular housing 27 carries a photographic camera 28 of special design and having an optical axis which extends at right angles to that of the telescopic sight 10 and at 45° with respect to the reflecting plane of the mirror 24. The camera 28 includes an extension tube 30 and an annular lens support 29 joined to the housing 27 in lightproof manner with the aid of a screw joint 31. The lens support 29 houses a photographic objective lens system 32 having an adjustable aperture diaphragm, the adjustment of which can be varied by means of a setting ring 33 rotatably supported on the lens support 29. A self-cocking camera shutter 34 co-ordinated with the objective lens system 32 is equipped with a remote operation connection fitting 35 so that the shutter can be triggered through a Bowden cable 36. The exposure period of the shutter 34 can be selected by means of a setting ring 37 which is also rotatably carried by the lens support 29. The shutter and exposure setting rings 33 and 37 are respectively provided with setting graduations 38 and 39 which can be aligned with respective datum marks 40 and 41 on the lens support 29.

The upper end of the tubular extension 30 carries a circular plate 42 which is secured on the extension 30 by means of screws 42*a* (FIG. 1). The diameter of the plate 42 is at least twice the external diameter of the extension 30, and the position of the plate with respect to the extension 30 is such that the centre of the plate 42 is situated outside the tubular extension 30, see FIG. 3. A pivot pin 43 is secured to the centre of the plate 42 and thus eccentrically with respect to the optical axis of the camera 28. The pivot pin 43 is arranged to rotatably support a cassette 44 loaded with photographic exposure material. The cassette 44 has a rectangular base 45 which is slidably supported on the plate 42, the plate 42 engaging in a circular recess 46 of the cassette base 45. The plate 42 has a circular opening 47 coincident with the optical axis of the camera. The cassette base 45 has a total of four circular gates 48, 49, 50 and 51 (FIGS. 1 and 3) each of which can in turn be brought into coincidence with the opening 47 in the plate 42 when the cassette 44 is turned about the pivot pin 43. Thus each time one of the gates 48 to 51 is brought into coincidence with the opening 47, it is open for exposure whereas the other gates are simultaneously closed off in lightproof manner by the plate 45.

A block 52 secured in the plate 45 has a bore which extends radially of the pivot pin 43. The bore houses a compression coil spring 53 and a ball 54. The spring 53 biases the ball 54 against the outer surface of the plate 42. The plate 42 has four equiangularly spaced notches 55 in its outer surface for selective engagement by the ball 54 which thus acts as part of a detent mechanism for ensuring each of the gates 48 to 51 is accurately located in the exposure position in turn. It will also be appreciated that one of the four lateral sides 56, 57, 58 and 59 of the cassette 44 is positioned at right angles with respect to the optical axis of the telescopic sight 10 when the ball 54 is engaged in one of the notches 55. Each gate 48, 49, 50 and 51 incorporates a thin and narrow transparent strip 60 bearing a marking 61 (FIG. 3), e.g. in the form of a number identifying the firearm used, which is recorded on the film during the photographic exposure. The transparent strip of each gate bears another marking so that the individual exposures can be identified later on. Appropriate markings 62 corresponding to the individual exposure numbers are formed on corresponding ones of the sides 56, 57, 58 and 59 of the cassette, care being taken to ensure that the marking of the gate situated in the exposure position corresponds in each case to that on the side of the cassette facing the marksman.

Apart from the specially designed cassette base 45, which has been described, the cassette 44 is a conventional cassette for instant photographic picture material. The cassette thus contains a pack 63 of exposure material sheets which can be exposed and subsequently withdrawn from the cassette through a slot 64 (FIG. 2), the development of the photographic exposure occurring automatically in known manner. The size of each sheet of exposure material carried by the cassette 44 is so dimensioned that there is room on one and the same sheet for four target plane pictures which are exposed consecutively through four gates 48, 49, 50 and 51. The image plane is marked 65 in FIG. 1. The sheet of exposure material ready for exposure is pushed into this image plane by means of a spring (not shown) housed in the cassette. A part 66 of the cassette 44, (see FIGS. 1 and 2) is hinged to allow the insertion of the pack 63 of exposure material. A clip 67 acts to lock the hinged part 66 in a closed position.

Figure 4:
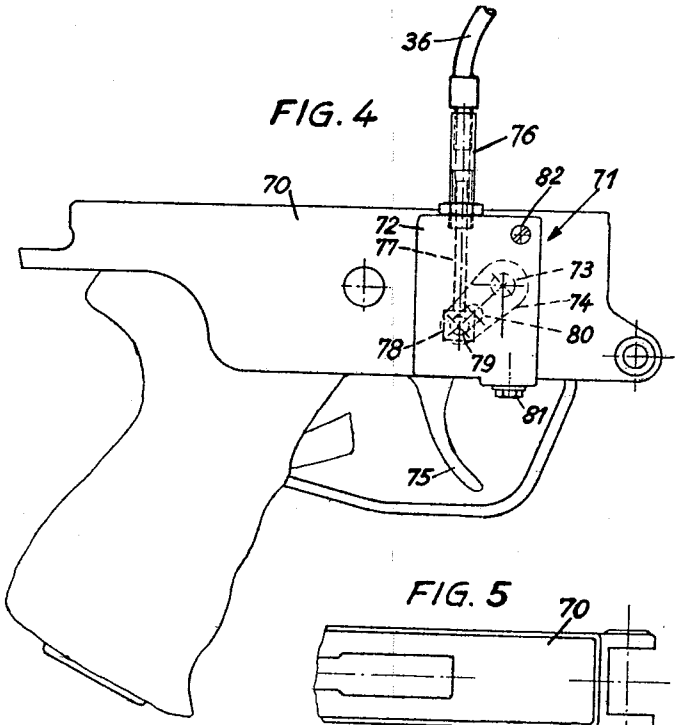
FIG. 4 shows a fragmentary side elevation of a rifle for supporting the apparatus of FIG. 1 and incorporating a release device for the apparatus.
Figure 5:
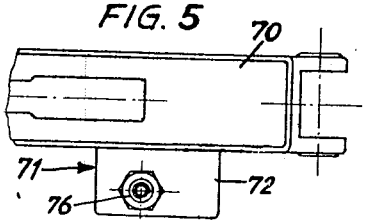
FIG. 5 is a fragmentary plan view of the rifle and release device of FIG. 4.

The rifle shown in FIGS. 4 and 5 includes a releasing device 71 connected to the Bowden cable 36 already referred to and secured on a part 70 of a rifle containing the lock. The releasing device includes a housing 72 supporting a lever 74 pivotably supported on a spindle 73. The spindle 73 is coupled to the rifle lock or action, so that upon operating the lock by actuating the trigger 75, the lever 74 pivots upwardly as viewed in FIG. 4. The spindle 73 is coupled to the pivot pin of a cock of the rifle lock by means of a claw or dog coupling. On the upper side of the housing 72, a tubular connection element 76 enables the Bowden cable 36 to be secured to the rifle in axially adjustable manner. A pin 77 is slidably supported by the connector 76. The upper end of the pin 77 is intended to co-operate with the core of the Bowden cable 36. The facing end of the pin 77 is connected to a slide member 78 which engages a peg-like projection 79 in a slot 80 of the lever 74, the slot 80 extending radially with respect to the spindle 73. The lever 74 and the pin 77 are coupled to each other by the slide member 78 and its projection 79, so that the pin is longitudinally displaced during the pivoting of the lever 74. Screws 81 and 82 act to secure the releasing device 71 on the part 70 of the rifle. The releasing member 71 can be removed from the rifle by freeing the screws 81 and 82.

In operation the telescopic sight 10 is secured on a rifle and the clamping sleeve 20 is clamped fast on the cylindrical terminal portion 15 of the telescopic sight 10 in the manner illustrated in FIGS. 1 and 2, so that the optical axis of the photographic camera 28 is vertically upwardly and the cassette 44 is located at the upper end of the camera. The releasing device 71 is secured to the part 70 of the rifle containing the lock or action, in the manner illustrated in FIGS. 4 and 5, and is connected to the connecting device 35 of the camera shutter 34 by the Bowden cable 36.

Photographic exposure material 63 for instant pictures is inserted into the cassette 44. The pivotal position of the cassette 44 is such initially that the lateral side 56 of the cassette having the slot 64 and marked with a numeral "1" is turned towards the marksman. The corresponding gate 48 is thus positioned in the exposure position above the opening 47 in the plate 42, and the transparent strip 60 of this gate is marked with the numeral "1". The action of the rifle is cocked, without the rifle being loaded with a live cartridge.

The marksman lines up the rifle with a selected target, while looking through the telescopic sight 10 via the eyepiece aperture 23, from the left in FIG. 1, and takes aim at the same target with the sight graticule 13,14. About half the light rays traversing the telescopic sight in the direction from the output lens 11 to the eye 12 are allowed to pass through by the mirror 14, so that the marksman can see the sight graticule 13, 14 and the image of the target plane, while the remaining light rays are deflected towards the objective lens system of the camera 28. If the trigger of the rifle is actuated and the rifle action is thereby released, the lever 74 of the releasing device 77 is pivoted upwardly as viewed in FIG. 4. The pin 77 is thus pushed upwardly and the core of the Bowden cable 36 is actuated. The camera shutter 34 is released by means of the Bowden cable 36 and an optical image of the target plane and of the sight graticule 13,14 is formed in the image plane 65 during the period of the exposure time set by means of the ring 37. This causes an exposure of the portion of the photographic material enclosed by the gate 48 in the exposure position. The sight graticule 13,14 and the image of the target plane visible in the telescopic sight 10 at the instant of actuation of the trigger 75, are thereby recorded photographically. The numeral "1" present on the transparent strip 60 for identifying the picture in question is also photographically recorded at the same time on a marginal portion of the picture.

The marksman thereupon turns the cassette 44 through an angle of 90° around the pivot pin 43 until the ball 54 is urged by the spring 53 in the next notch 55 in the plate 42. After re-cocking the rifle lock or action, the above described cycle is repeated to produce the photographic picture of a target image plane but this time within an area on the photographic sheet defined by the gate 49. After rotation of the cassette 44 through another 90°, a third target plane image can be recorded photographically on an area of the photographic sheet defined by the gate 50. Finally after yet further rotation of the cassette 44 through another 90°, a fourth target image plane can be produced photographically on an area of the photographic sheet defined by the gate 51. The exposure material in question is then pulled out of the cassette 44 through the slot 64, the developing of the photographically exposed material taking place automatically. The four different target plane pictures, each of which bears a unique marking on a marginal portion, namely one of the numerals "1", "2", "3" and "4", are visible after developing, on one and the same sheet.

Before the start of the next series of four shots, the cassette 44 is turned through another 90°, until it reaches its initial position again, which is illustrated in FIGS. 1 to 3.

After freeing the Bowden cable 36, the clamping sleeve 20 can be removed from the telescopic sight together with the components connected to it, and the rifle can then be used for shooting with live ammunition in the usual manner. If desirable, the release device 71 can also be removed from the part 70 of the rifle containing the rifle lock or action, but this is unnecessary in many cases.

The device described offers a series of advantages, namely a relatively uncomplicated and robust structure, relatively low procurement costs, simple operation without disturbing the otherwise customary handling of the firearm, the possibility of rapid and precise checking of the target subject aimed at and "hit" in each case upon actuation of the trigger, a relatively low operating cost (expenditure on photographic exposure material) since several target plane pictures may be produced on the same sheet in each instance.

In a modification instead of the Bowden cable 36, another effective coupling, for example an electrical, a pneumatic or a hydraulic coupling, can be used between the release device 71 and the camera shutter 34. Instead the release of the camera shutter 34 can be effected by means of ultrasonic or radio waves. Instead of being arranged to house instant picture photographic material, the cassette 44 can be adapted to take a negative film pack or a rollfilm strip. Instead of a manually rotatable cassette, a cassette for rollfilm and for motorised film advance after each exposure, can be used. A kinematographic moving picture camera may be incorporated if appropriate, instead of a single or series exposure camera. It is also possible for the camera or its cassette to be constructed so as to be interchangeable. If, as shown, the cassette 44 is rotatably arranged and has several gates 48 to 51, the number of gates can be made greater of smaller than four, but of course the number of notches 55 in the plate 42 will need to be increased or decreased accordingly. Finally, it is possible to integrate the optical beam splitter element 24 into the optical system of the telescopic sight 10 rather than to house it in an extension to the telescopic sight.

We claim:

1. In a firearm having a trigger and a telescopic sight through which light from a target zone can pass along the optical axis of the sight through an eyepiece to reach the eye of an observer, target sight recording apparatus comprising an optical beam splitter element rigid with the telescopic sight for diverting a fraction of the light passing through the telescopic sight along a path extending at an angle to the optical axis, a photographic camera rigid with the telescopic sight and inclined at an angle to receive the deflected light, the camera having an objective lens system, a camera shutter, and a cassette for housing photographic exposure material all aligned along the optical axis of the camera and a shutter releasing device coupled to actuate the camera shutter, and means coupling the shutter release device with the trigger of the firearm so that upon operating the trigger the camera shoots the picture which at that instant the observer can view through the telescopic sight.

2. Apparatus according to claim 1, including a casing housing the beam splitter element, means securing the housing to the telescopic sight to lie between the eyepiece and the observer, the casing defining apertures at opposite ends aligned with the optical axis of the sight to enable the observer to view the eyepiece, and defining a further aperture aligned with the path to allow the deflected light to pass to the photographic camera, and means securing the camera to the casing.

3. Apparatus according to claim 2, wherein the photographic camera further includes an extension tube supporting the cassette at one end and the objective lens system at the other end, and means for securing the objective lens system to the casing around the said further aperture in a light-tight manner.

4. Apparatus according to claim 1, wherein the optical axis of the camera and the optical axis of the telescopic sight are inclined at right angles to each other and are each inclined at least at an angle of 45° with respect to the plane of the beam splitter element.

5. Apparatus according to claim 1, including means for pivotally supporting the cassette in the camera for rotation about an axis which is parallel to but spaced from the optical axis of the camera to allow different portions of the photographic material in the cassette to be successively brought into an exposure position in the camera.

6. Apparatus according to claim 5, wherein the camera has a circular support plate defining an aperture aligned with the optical axis of the camera, and the cassette has a base constrained for slidable movement on the support plate, the cassette defining a plurality of light gates which can be successively brought into coincidence with the aperture in the plate by sliding the cassette relative to the support plate, and detent means providing co-operation between the support plate and cassette to define the positions in which each of the light gates are aligned with the aperture in the support plate.

7. Apparatus according to claim 6, wherein each light gate includes a gate identifying marking located in the light path through the camera when that gate is aligned with the opening on the support plate.

8. Apparatus according to claim 7, wherein the cassette base has a total of four gates and the cassette has four sides extending at right angles to one another, each side carrying a marking corresponding to the markings of the gate, the sides of the cassette being such that when a gate is aligned with the aperture in the support plate the side carrying the corresponding marking extends at right angles to the optical axis of the telescopic sighting.

9. Apparatus according to claim 5, wherein the cassette houses instant-picture photographic material.

10. Apparatus according to claim 1, wherein the coupling means comprises a Bowden cable.

11. Apparatus according to claim 1, wherein the coupling means includes the lock or action of the firearm which is coupled to the trigger.

12. Apparatus according to claim 1, wherein the camera shutter is a variable speed shutter and wherein the objective lens system includes an adjustable aperture.

13. In combination, a firearm having a trigger and a sight, a camera having a remotely operable shutter mounted on the firearm to view the target through the sight of the firearm, means coupling the trigger of the firearm with the camera shutter so that upon operating the trigger the camera is operated to shoot the picture at that instant an observer can view through the sight, an eyepiece and a semireflecting mirror both mounted on the firearm, the semireflecting mirror providing a first light path from the camera to the sight and a second light path from the eyepiece to sight, and a film cassette housing a film having a plurality of frames, means rotatably mounting the cassette in the camera for movement into successive ones of a plurality of discrete angular positions to enable a plurality of picture shots to be recorded on the same frame of the film.

* * * * *